US006082226A

United States Patent [19]

Lin

[11] Patent Number: 6,082,226

[45] Date of Patent: Jul. 4, 2000

[54] RATCHET TOOL HAVING A RATCHET DIRECTION POSITIONING DEVICE

[76] Inventor: Jack Lin, No. 103, Nan-Kang 3 Rd., Nan-Kang Industrial Areas, Nan-Tou, Taiwan

[21] Appl. No.: 09/336,798

[22] Filed: Jun. 21, 1999

[51] Int. Cl.[7] ..... B25B 13/46

[52] U.S. Cl. ..... 81/62; 81/61; 81/60; 192/43.1

[58] Field of Search ..... 81/62, 63.1, 63.2, 81/61, 60

[56] References Cited

U.S. PATENT DOCUMENTS 5,437,212 8/1995 Thompson et al. ..... 81/63.1
5,537,899 7/1996 Diedrich ..... 81/57.39
5,613,585 3/1997 Tiede ..... 192/43.1
5,988,337 11/1999 Liu ..... 192/43.1

*Primary Examiner*—James G. Smith
*Assistant Examiner*—Hadi Shakeri
*Attorney, Agent, or Firm*—Charles E Baxley, Esq.

[57] ABSTRACT

A ratchet tool includes a shaft and a handle to which a direction selection collar is mounted and a ratchet member is received in the handle. The ratchet member has inner toothed periphery and two pawl members engaged with the inner toothed periphery. The ratchet member has three dents defined in one of two ends thereof and the direction selection collar has a positioning member embedded therein which is movably received in one of the dents when rotating the collar. The collar has a rod extending between the two pawl members, the rod pivoting one of the pawl member to disengage from the inner toothed periphery by rotating the collar.

6 Claims, 6 Drawing Sheets

RATCHET TOOL HAVING A RATCHET DIRECTION POSITIONING DEVICE

FIELD OF THE INVENTION

The present invention relates to a ratchet tool having a positioning member in the direction selection collar and the positioning member is received in one of three dents in the ratchet member so as to provide a clear index feature for the users.

BACKGROUND OF THE INVENTION

A conventional ratchet tool includes a ratchet mechanism which has a ratchet member and a pawl which is engaged with the ratchet member. The pawl member is connected to an operation lever on the outside of the tool so that when operating the lever, the pawl is pivoted to let one of two toothed ends engaged with the ratchet member so that the direction of the ratchet to output a torque is decided. Nevertheless, when choosing the ratchet direction, the user cannot positively be sure that the pawl is pivoted and engaged with the ratchet member as desired because there is no positioning device to clearly show that which end of the pawl is engaged with the ratchet member.

The present invention intends to provide a ratchet tool having a direction selection collar rotatably mounted to the handle and a positioning member is embedded in the collar so as to be received in one of three dents in the ratchet member to let the user know that which direction of the ratchet member is set for applying a torque to the object.

The present invention improves the positioning feature for the ratchet tool and this makes the user to feel confident when using the ratchet tool.

SUMMARY OF THE INVENTION

In accordance with one aspect of the present invention, there is provided a ratchet tool comprising a ratchet member having an inner toothed periphery and three dents defined in the first end of the ratchet member. Two pawl members are pivotally received in the ratchet member and each pawl member has a toothed end engaged with the inner toothed periphery. A spring is biased between the two pawl members. A frame is connected to the second end of the ratchet member and two pins extend from the frame and respectively extend through the two pawl members.

A direction selection collar has a rod extending from one of two ends of the collar and rod passes between the two pawl members so that when rotating the direction selection collar, the rod pivots one of the two pawl members to disengaged from the inner toothed periphery. A positioning member is biasedly embedded in the direction selection collar and located beside the rod. The positioning member is received in one of the three dents of the ratchet member.

A cap is mounted to the direction selection collar and connected to the two pins. A shaft has a circular section and a polygonal section, wherein the circular section extends through the cap and the direction selection collar, and the polygonal section passes between the two pawl members and is securely engaged with the frame.

The object of the present invention is to provide a ratchet tool which has a ratchet direction positioning device which allows the user to clearly know which ratchet direction is set.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
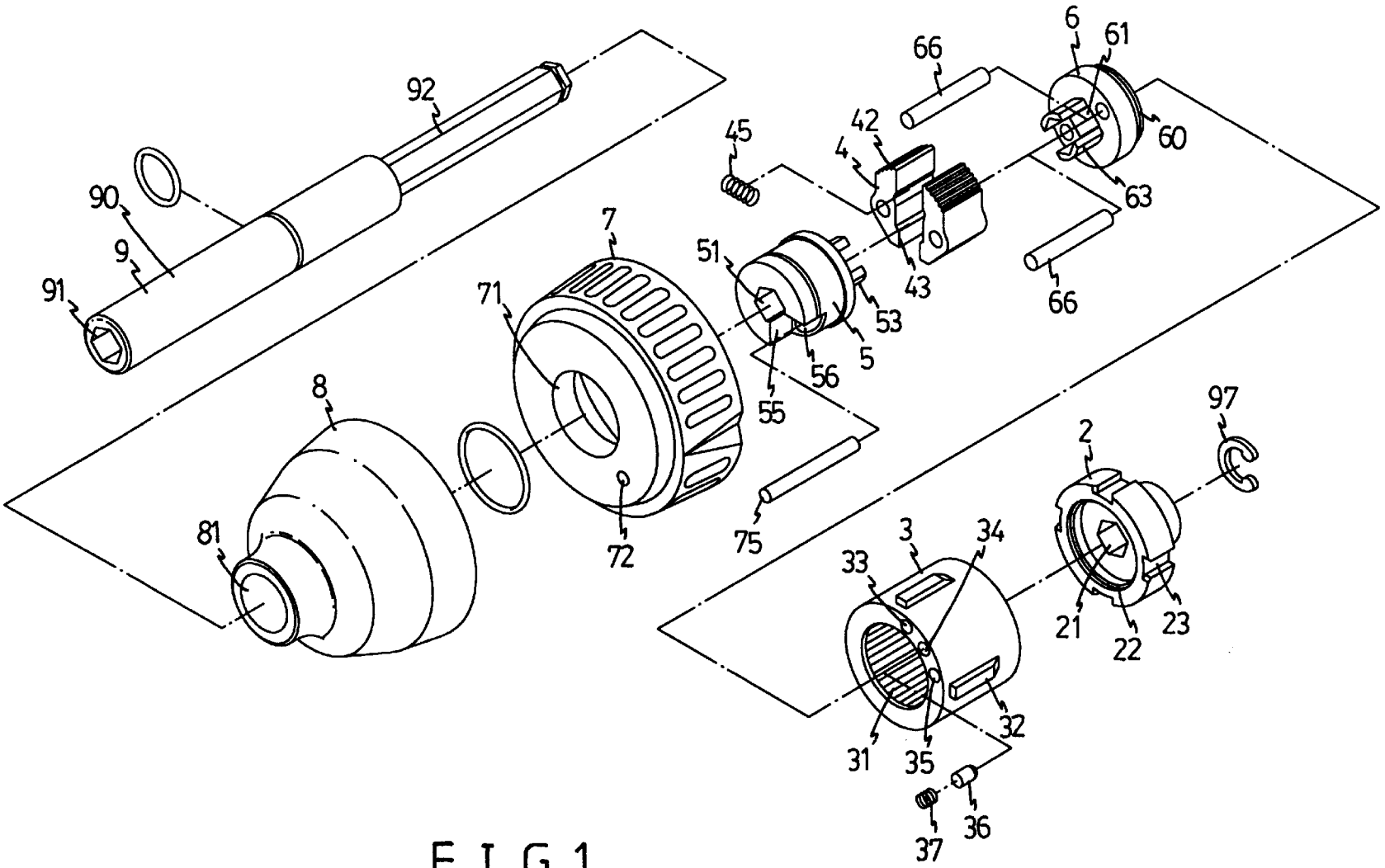
FIG. 1 is an exploded view of the ratchet tool in accordance with the present invention.
Figure 2:
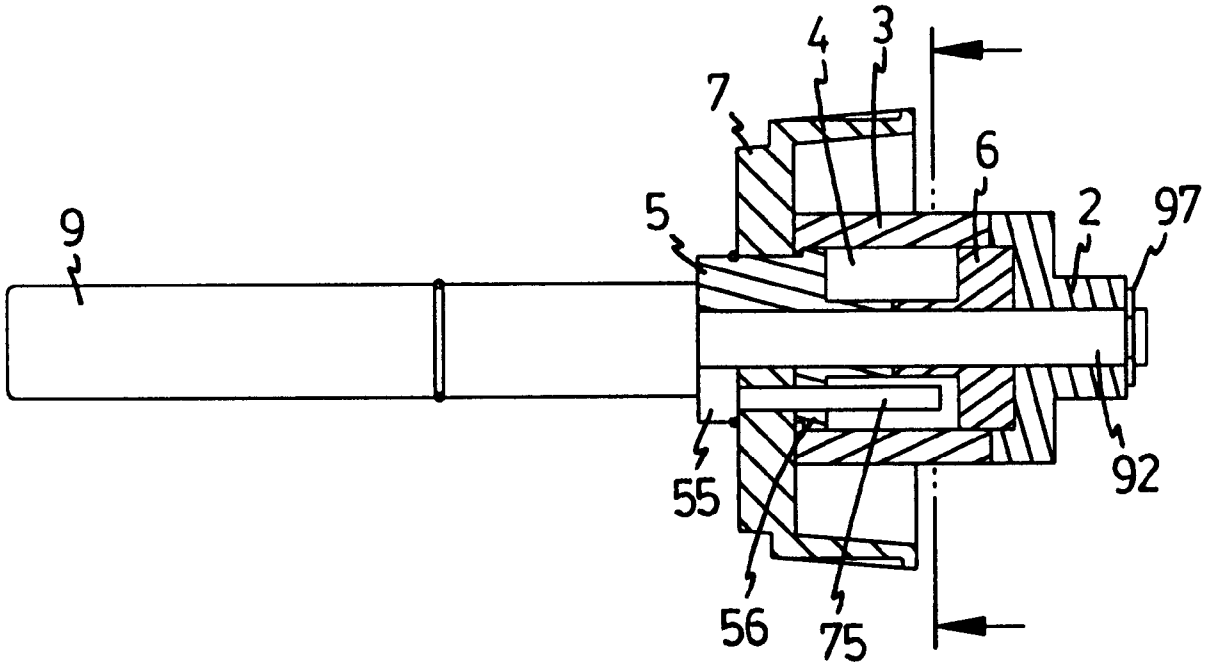
FIG. 2 is a side elevational view, partly in section, of the combination of the ratchet mechanism in the ratchet tool accordance with the present invention.
Figure 3:
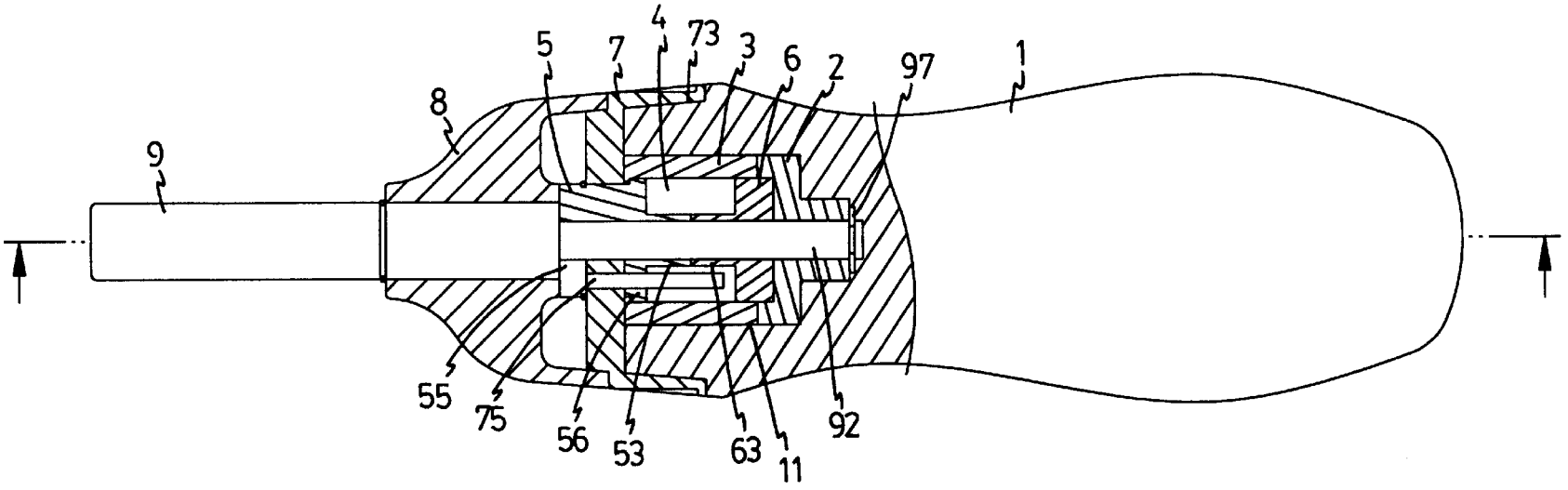
FIG. 3 is a side elevational view, partly in section, of the ratchet tool in accordance with the present invention wherein the rod is located between the two pawl members.

Referring to FIGS. 1 to 4, the ratchet tool in accordance with the present invention comprises a ratchet member (3) which is a tubular member and has three dents (33, 34, 35) defined in the first end of the ratchet member (3). The ratchet member (3) has an inner toothed periphery (31) and a plurality of ribs (32) extend from the outside of the ratchet member (30) so as to securely received in the recess (11) in the handle (1) of the ratchet tool. A frame (6) is connected to the second end of the ratchet member (3) and two pins (66) extend from the frame (6). The two pins (66) respectively extend into the ratchet member (3) and through two pawl members (4) so that the two pawl members (4) are pivotally received in the ratchet member (3) and each pawl member (4) has a toothed end (42) which is engaged with the inner toothed periphery (31). A spring (45) is biased between the two pawl members (4).

Figure 5:
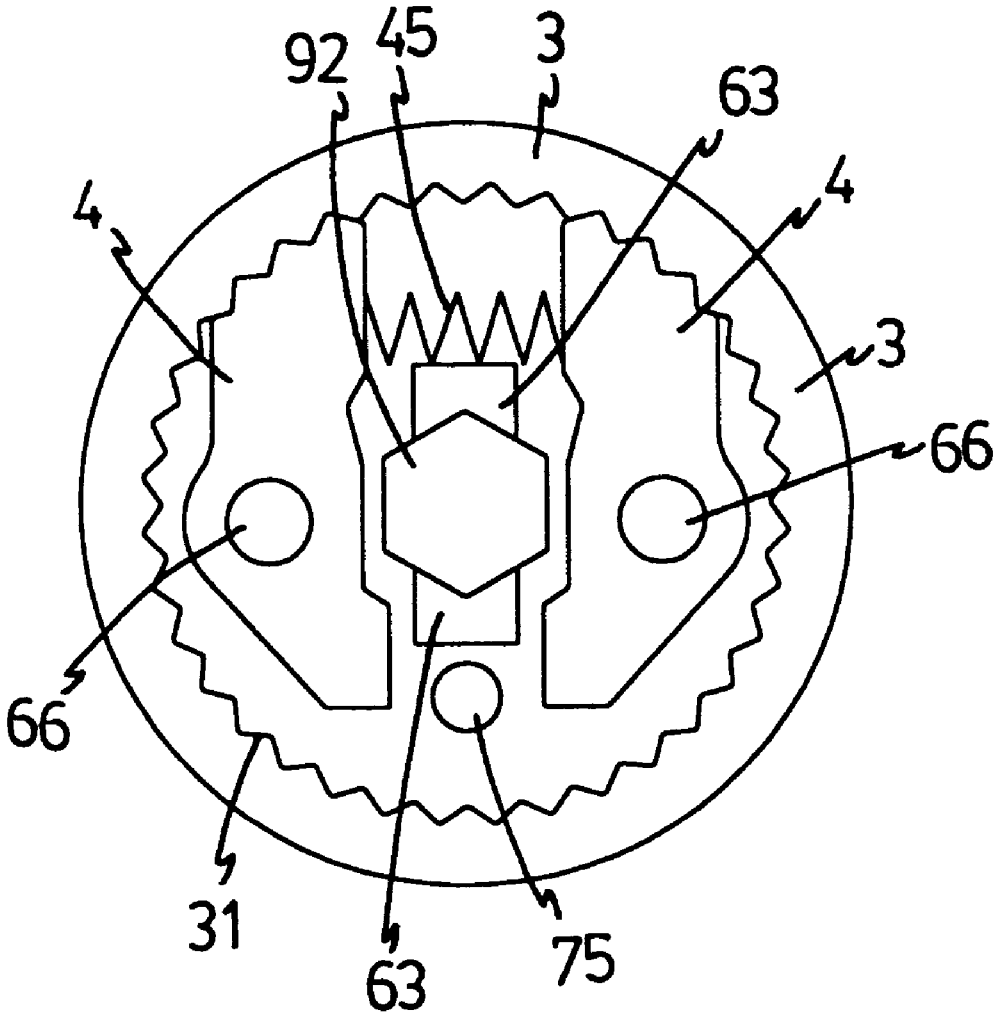
FIG. 5 is an illustrative view to show the rod is located between the two pawl members which are engaged with the ratchet member.
Figure 6:
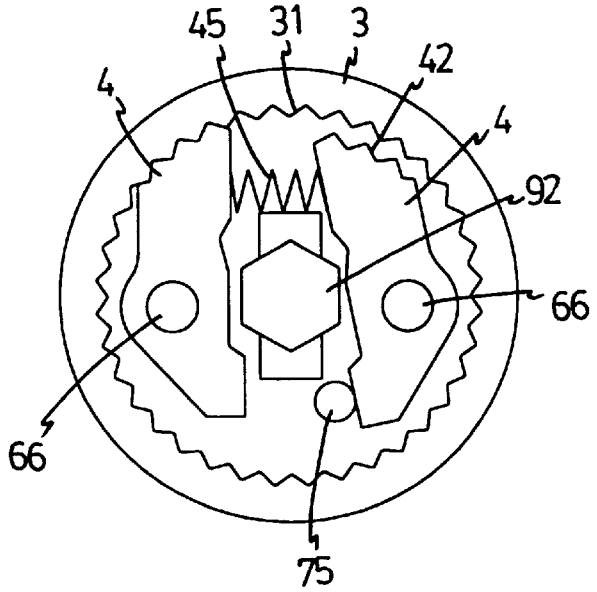
FIG. 6 is an illustrative view to show the rod is shifted to push one of the two pawl members to disengage the pawl member from the ratchet member.
Figure 7:
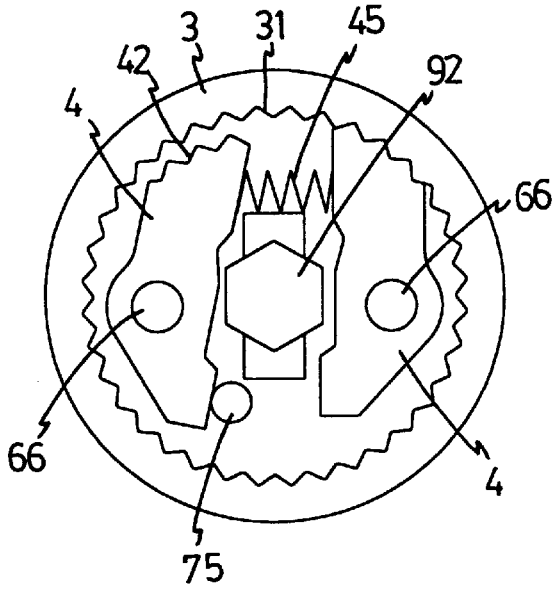
FIG. 7 is an illustrative view to show the rod is shifted to push the other pawl member to disengage the pawl member from the ratchet member.

A direction selection collar (7) is rotatably mounted to the handle (1) and has a rod (75) extending from one of two ends of the collar (7). A retaining member (5) is located between the direction selection collar (7) and the pawl members (4). The retaining member (5) has a recess (55) defined radially therein and a fan-shaped passage (56) is defined through the bottom defining the recess (55) so that the rod (75) movably extends through the passage (56). The retaining member (5) has two first lugs (53) extending therefrom and the frame (6) has two second lugs (63) extending therefrom. The two first lugs (53) contact the two second lugs (63) so that the two pawl members (4) are located between the frame (6) and the retaining member (5) separated by the first lugs (53) and the second lugs (63). Therefore, the two pawl members (4) will not contact the retaining member (5) and the frame (6). The direction selection collar (7) has a hole 72 defined therethrough for one end of the rod (75) securely received therein. The rod (75) passes between the two pawl members (4) as shown in FIG. 5 so that when rotating the direction selection collar (7), the rod (75) pivots one of the two pawl members (4) to disengaged from the inner toothed periphery (31) as illustrated in FIGS. 6 and 7.

Figure 4:
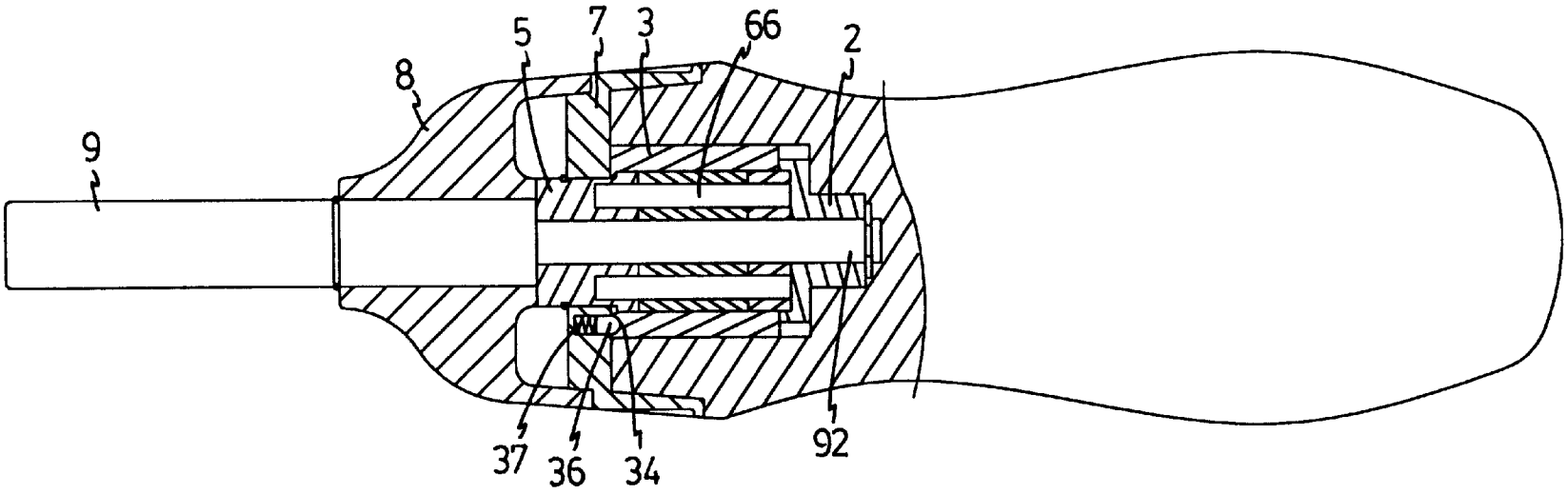
FIG. 4 is a side elevational view, partly in section, of the ratchet tool in accordance with the present invention, wherein the two pawl s are pivotally connected to two pins.

A positioning member (36) is biasedly embedded in the direction selection collar (7) with a spring (37) connected thereto, and located beside the rod (75). The positioning member (36) will be received in one of the three dents (33, 34, 35) of the ratchet member (3) when rotating the direction selection collar (7). In other words, when rotating the direction selection collar (7), the user will know where the rod (75) is now located by feeling the positioning member (36) in one of the three dents (33, 34, 35). A cap (8) is mounted to the direction selection collar (7) and connected to the two pins (66) as shown in FIG. 4.

An end member (2) is connected to the frame (6) and has a plurality of grooves (23) defined in the outside thereof so as to be adapted securely received in the handle. The frame (6) has a threaded insertion (60) and the end member (2) has a threaded recess (22) which is engaged with the threaded insertion (60).

It is to be noted that each pawl member (4) has a surface (43) defined therein and the rod (75) is located between the two surfaces (43) of the two pawl members (4) so that when the rod (75) is moved by rotating the direction selection collar (7), the rod (75) will push the pawl members (4) at the surface (43) of each pawl member (4).

A shaft (9) has a circular section (90) and a polygonal section (92). The circular section (90) extends through a central hole (81) of the cap (8) and a hole (71) of the direction selection collar (7), and the polygonal section (92) securely engaged with a polygonal hole (51) of the retaining member (5), a polygonal hole (61) of the frame (6) and a polygonal hole (21)) of the end member (2). The distal end of the polygonal section (92) is then clamped by a C-shaped clamp (97). The circular section (90) has a polygonal recess (91) defined in the distal end thereof so as to receive a bit for example. The polygonal section (92) passes between the two pawl members (4) and received between the two pairs of first lugs (53) and second lugs (63).

Therefore, when rotating the direction selection collar (7), the rod (75) is moved to pivot one of the pawl members (4) and the positioning member (36) will be removed from one of the dents (33, 34, 35) to another dent so that the user will know that one of the pawl members (4) is pivoted correctly. When the direction selection collar (7) is rotated to the neutral position, the pivoted pawl member (4) is then engaged with the inner toothed periphery (31) again by the spring (45).

While we have shown and described various embodiments in accordance with the present invention, it should be clear to those skilled in the art that further embodiments may be made without departing from the scope and spirit of the present invention.

What is claimed is:

1. A ratchet tool having a handle, comprising:

a ratchet member (3) being a tubular member and having three dents (33, 34, 35) defined in the one end of said ratchet member (3), said ratchet member (3) having an inner toothed periphery (31);

two pawl members (4) pivotally received in said ratchet member (3) and each pawl member (4) having a toothed end (42) engaged with said inner toothed periphery (31), a spring (45) biased between said two pawl members (4);

a frame (6) connected to another end of said ratchet member (3) and two pins (66) extending from said frame (6), said two pins (66) respectively extending through said two pawl members (4);

a direction selection collar (7) having a rod (75) extending from one of two ends of said collar (7), said rod (75) passing between said two pawl members (4) so that when rotating said direction selection collar (7), said rod (75) pivots one of said two pawl members (4) to disengaged from said inner toothed periphery (31), a positioning member (36) biasedly embedded in said direction selection collar (7) and located beside said rod (75), said positioning member (36) received in one of said three dents (33, 34, 35) of said ratchet member (3);

a cap (8) mounted to said direction selection collar (7) and connected to said two pins (66), and a shaft (9) having a circular section (90) and a polygonal section (92), said circular section (90) extending through said cap (8) and said direction selection collar (7), and said polygonal section (92) passing between said two pawl members (4) and securely engaged with said frame (6) which is adapted to be fixedly received in the handle.

2. The ratchet tool as claimed in claim 1, wherein each pawl member (4) has a surface (43) defined therein and said rod (75) is located between said two surfaces (43) of said two pawl members (4).

3. The ratchet tool as claimed in claim 1 further comprising an end member (2) connected to said frame (6) and has a plurality of grooves (23) defined in the outside thereof so as to be adapted securely received in the handle.

4. The ratchet tool as claimed in claim 3, wherein said frame (6) has a threaded insertion (60) and said end member (2) has a threaded recess (22) which is engaged with said threaded insertion (60).

5. The ratchet tool as claimed in claim 1 further comprising a retaining member (5) which is located between said direction selection collar (7) and said pawl members (4), said retaining member (5) securely mounted to said polygonal section (92) of said shaft (9) and having a passage (56) defined therethrough, said rod (75) movably extending through said passage (56).

6. The ratchet tool as claimed in claim 5, wherein said retaining member (5) has two first lugs (53) extending therefrom and said frame (6) has two second lugs (63) extending therefrom, said two first lugs (53) contacting said two second lugs (63), said two pawl members (4) located between said frame (6) and said retaining member (5) separated by said first lugs (53) and said second lugs (63).

* * * * *